US007871748B2

(12) United States Patent
Wu

(10) Patent No.: US 7,871,748 B2
(45) Date of Patent: Jan. 18, 2011

(54) IRON CONTAINING HOLE BLOCKING LAYER CONTAINING PHOTOCONDUCTORS

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 840 days.

(21) Appl. No.: 11/831,440

(22) Filed: Jul. 31, 2007

(65) Prior Publication Data

US 2009/0035673 A1 Feb. 5, 2009

(51) Int. Cl.
*G03G 5/043* (2006.01)

(52) U.S. Cl. ..... 430/65; 430/58.75; 430/59.4; 430/60; 430/64

(58) Field of Classification Search ..... 430/58.75, 430/59.4, 60, 64, 65
See application file for complete search history.

(56) References Cited

U.S. PATENT DOCUMENTS 4,226,928 A * 10/1980 Nakazawa et al. ..... 430/58.25
5,473,064 A 12/1995 Mayo et al.
5,482,811 A 1/1996 Keoshkerian et al.
5,521,306 A 5/1996 Burt et al.
5,747,206 A * 5/1998 Agata et al. ..... 430/64
2004/0126685 A1* 7/2004 Horgan et al. ..... 430/58.3
2006/0057480 A1* 3/2006 Lin et al. ..... 430/65
2007/0049677 A1 3/2007 Lin et al.
2007/0298342 A1* 12/2007 Wu et al. ..... 430/58.75

FOREIGN PATENT DOCUMENTS

JP 10-073942 * 3/1998

OTHER PUBLICATIONS

Translation of JP 10-073942 published Mar. 1998.*
Jin Wu et al., U.S. Appl. No. 11/764,489 on Hole Blocking Layer Containing Photoconductors, filed Jun. 18, 2007.
Liang-Bih Lin et al., U.S. Appl. No. 11/403,981 on Improved Imaging Member, filed Apr. 13, 2006.
Jin Wu et al., U.S. Appl. No. 11/481,642 on Electrophotographic Imaging Member Undercoat Layers, filed Jul. 6, 2006.
Liang-Bih Lin et al., U.S. Appl. No. 11/496,790 on Polyester Containing Member, filed Aug. 1, 2006.
Jin Wu et al., U.S. Appl. No. 11/714,600 on Hole Blocking Layers Containing Photoconductors, filed Mar. 6, 2007.

* cited by examiner

*Primary Examiner*—Christopher RoDee
*Assistant Examiner*—Peter L Vajda
(74) *Attorney, Agent, or Firm*—Oliff & Berridge, PLC

(57) ABSTRACT

A photoconductor that includes a substrate; an undercoat layer thereover wherein the undercoat layer contains, for example, a metal oxide, and an iron containing compound; a photogenerating layer; and at least one charge transport layer.

26 Claims, No Drawings

IRON CONTAINING HOLE BLOCKING LAYER CONTAINING PHOTOCONDUCTORS

CROSS REFERENCE TO RELATED APPLICATIONS

Illustrated in U.S. application Ser. No. 11/831,453, now U.S. Pat. No. 7,670,737, filed Jul. 31, 2007, the disclosure of which is totally incorporated herein by reference, is a photoconductor comprising a substrate; an undercoat layer thereover wherein the undercoat layer comprises a metal oxide, and an ultraviolet light absorber component; a photogenerating layer; and at least one charge transport layer.

Illustrated in copending U.S. application Ser. No. 11/831,469. U.S. Publication No. 20090035675, filed Jul. 31, 2007, the disclosure of which is totally incorporated herein by reference, is a photoconductor comprising a substrate; an undercoat layer thereover wherein the undercoat layer comprises a metal oxide, and a copper containing compound; a photogenerating layer; and at least one charge transport layer.

Illustrated in copending U.S. application Ser. No. 11/831,476, U.S. Publication No. 20090035676, filed Jul. 31, 2007, the disclosure of which is totally incorporated herein by reference, is a photoconductor comprising a substrate; an undercoat layer thereover wherein the undercoat layer comprises a metal oxide and an iodonium containing compound; a photogenerating layer; and at least one charge transport layer.

Illustrated in U.S. application Ser. No. 11/211,757, U.S. Publication No. 20070049677, now U.S. Pat. No. 7,544,452, filed Aug. 26, 2005, entitled Thick Electrophotographic Imaging Member Undercoat Layers, the disclosure of which is totally incorporated herein by reference, are binders containing metal oxide nanoparticles and a co-resin of phenolic resin and aminoplast resin, and electrophotographic imaging member undercoat layer containing the binders.

Illustrated in U.S. application Ser. No. 10/942,277, U.S. Publication No. 20060057480, now U.S. Pat. No. 7,312,007, filed Sep. 16, 2004, entitled Photoconductive Imaging Members, the disclosure of which is totally incorporated herein by reference, is a photoconductive member containing a hole blocking layer, a photogenerating layer, and a charge transport layer, and wherein the hole blocking layer contains a metallic component like a titanium oxide and a polymeric binder.

Disclosed in copending U.S. application Ser. No. 11/764,489, U.S. Publication No. 20080311447, filed Jun. 18, 2007 on Hole Blocking Layer Containing Photoconductors, the disclosure of which is totally incorporated herein by reference, is a photoconductor comprising a substrate; an undercoat layer thereover wherein the undercoat layer comprises a metal oxide, and an electron donor, an electron acceptor charge transfer complex; a photogenerating layer; and at least one charge transport layer.

Disclosed in application U.S. application Ser. No. 11/403,981, now U.S. Pat. No. 7,604,914, filed Apr. 13, 2006, entitled Imaging Members, the disclosure of which is totally incorporated herein by reference, is an electrophotographic imaging member comprising a substrate, an undercoat layer disposed on the substrate, wherein the undercoat layer comprises a polyol resin, an aminoplast resin, and a metal oxide dispersed therein; and at least one imaging layer formed on the undercoat layer, and wherein the polyol resin is, for example, selected from the group consisting of acrylic polyols, polyglycols, polyglycerols, and mixtures thereof.

Illustrated in U.S. patent application Ser. No. 11/481,642, now U.S. Pat. No. 7,321,112, filed Jul. 6, 2006, the disclosure of which is totally incorporated by reference herein, is an imaging member including a substrate; a charge generation layer positioned on the substrate; at least one charge transport layer positioned on the charge generation layer; and an undercoat or hole blocking layer positioned on the substrate on a side opposite the charge generation layer, the undercoat layer comprising a binder component, and a metallic component comprising a metal thiocyanate and metal oxide.

Disclosed in U.S. application Ser. No. 11/496,790, now U.S. Pat. No. 7,560,208, filed Aug. 1, 2006, the disclosure of which is totally incorporated herein by reference, is a photoconductor member comprising a substrate; an undercoat layer thereover wherein the undercoat layer comprises a polyol resin, an aminoplast resin, a polyester adhesion component, and a metal oxide; and at least one imaging layer formed on the undercoat layer.

Disclosed in U.S. application Ser. No. 11/714,600, now U.S. Pat. No. 7,579,126, filed Mar. 6, 2007 on Hole Blocking Layers Containing Photoconductors, the disclosure of which is totally incorporated herein by reference, is a photoconductor comprising a substrate; an undercoat layer thereover wherein the undercoat layer comprises an electroconducting component dispersed in a rapid curing polymer matrix; a photogenerating layer, and at least one charge transport layer.

The appropriate components and processes, number and sequence of the layers, component and component amounts in each layer, and the thicknesses of each layer of the above copending applications, and more specifically, a number of the undercoat or blocking layer components of U.S. application Ser. No. 11/831,453, now U.S. Pat. No. 7,670,737, may be selected for the present disclosure photoconductors in embodiments thereof.

BACKGROUND

There are disclosed herein hole blocking layers, and more specifically, photoconductors containing a hole blocking layer or undercoat layer (UCL) comprised, for example, of a metal oxide, a polymer binder and an iron containing compound, such as iron (III) acetylacetonate, and which layer can be situated between the supporting substrate and the photogenerating layer. More specifically, there are disclosed herein undercoat or hole blocking layers comprised of some of the components as illustrated in the copending applications referred to herein, such as a metal oxide like a titanium dioxide, and an iron containing component.

In embodiments, photoconductors comprised of the disclosed hole blocking or undercoat layer enable, for example, undesirable light shock reductions, the minimization or substantially elimination of undesirable ghosting on developed images, such as xerographic images, including improved ghosting at various relative humidities; excellent cyclic and stable electrical properties; minimal charge deficient spots (CDS); and compatibility with the photogenerating and charge transport resin binders, such as polycarbonates. Charge blocking layer and hole blocking layer are generally used interchangeably with the phrase "undercoat layer".

The need for excellent print quality in xerographic systems is increasing, especially with the advent of color. Common print quality issues can be dependent on the components of the undercoat layer (UCL). In certain situations, a thicker undercoat is desirable, but the thickness of the material used for the undercoat layer may be limited by, in some instances, the inefficient transport of the photoinjected electrons from the generator layer to the substrate. When the undercoat layer is too thin, then incomplete coverage of the substrate may result due to wetting problems on localized unclean substrate surface areas. The incomplete coverage produces pin holes which can, in turn, produce print defects such as charge deficient spots (CDS) and bias charge roll (BCR) leakage breakdown. Other problems include "ghosting" resulting from, it is believed, the accumulation of charge somewhere in the photoreceptor. Removing trapped electrons and holes residing in the imaging members is a factor to preventing ghosting. During the exposure and development stages of xerographic cycles, the trapped electrons are mainly at or near the interface between the charge generation layer (CGL) and the undercoat layer (UCL), and holes are present mainly at or near the interface between the charge generation layer and the charge transport layer (CTL). The trapped charges can migrate according to the electric field during the transfer stage where the electrons can move from the interface of CGL/UCL to CTL/CGL, or the holes from CTL/CGL to CGL/UCL, and become deep traps that are no longer mobile.

Consequently, when a sequential image is printed, the accumulated charge results in image density changes in the current printed image that reveals the previously printed image. Thus, there is a need to minimize or eliminate charge accumulation in photoreceptors without sacrificing the desired thickness of the undercoat layer, and a need for permitting the UCL to properly adhere to the other photoconductive layers, such as the photogenerating layer, for extended time periods, such as for example, about 2,000,000 simulated xerographic imaging cycles. Thus, conventional materials used for the undercoat or blocking layer possess a number of disadvantages resulting in adverse print quality characteristics. For example, ghosting, charge deficient spots and bias charge roll leakage breakdown are problems that commonly occur. With regard to ghosting, which is believed to result from the accumulation of charge somewhere in the photoconductor, consequently, when a sequential image is printed, the accumulated charge results in image density changes in the current printed image that reveals the previously printed image.

Thick undercoat layers are sometimes desirable for photoreceptors as such layers permit photoconductor life extension and carbon fiber resistance. Furthermore, thicker undercoat layers permit the use of economical substrates in the photoreceptors. Examples of thick undercoat layers are disclosed in U.S. application Ser. No. 10/942,277, filed Sep. 16, 2004, U.S. Publication 20060057480, entitled Photoconductive Imaging Members, the entire disclosure of which is totally incorporated herein by reference. However, due primarily to insufficient electron conductivity in dry and cold environments, the residual potential in conditions, such as 10 percent relative humidity and 70° F., can be high when the undercoat layer is thicker than about 15 microns, and moreover, the adhesion of the UCL may be poor, disadvantages avoided or minimized with the UCL of the present disclosure.

Also included within the scope of the present disclosure are methods of imaging and printing with the photoconductive devices illustrated herein. These methods generally involve the formation of an electrostatic latent image on the imaging member, followed by developing the image with a toner composition comprised, for example, of a thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the imaging members, photoconductor drums, and flexible belts disclosed herein can be selected for the Xerox Corporation iGEN3® machines that generate with some versions over 100 copies per minute. Processes of imaging, especially xerographic imaging and printing, including digital, and/or high speed color printing, are thus encompassed by the present disclosure.

The photoconductors disclosed herein are in embodiments sensitive in the wavelength region of, for example, from about 400 to about 900 nanometers, and in particular from about 650 to about 850 nanometers, thus diode lasers can be selected as the light source.

REFERENCES

Illustrated in U.S. Pat. No. 6,913,863, the disclosure of which is totally incorporated herein by reference, is a photoconductive imaging member comprised of an optional supporting substrate, a hole blocking layer thereover, a photogenerating layer, and a charge transport layer, and wherein the hole blocking layer is comprised of a metal oxide, a mixture of phenolic resins, and wherein at least one of the resins contains two hydroxy groups.

Illustrated in U.S. Pat. Nos. 6,255,027; 6,177,219, and 6,156,468, each of the disclosures thereof being totally incorporated herein by reference, are, for example, photoreceptors containing a charge blocking layer of a plurality of light scattering particles dispersed in a binder, reference for example, Example I of U.S. Pat. No. 6,156,468, wherein there is illustrated a charge blocking layer of titanium dioxide dispersed in a specific linear phenolic binder of VARCUM®, available from OxyChem Company.

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerating layer, and a charge transport layer, and wherein the blocking layer is comprised of a polyhaloalkylstyrene.

Layered photoconductors have been described in numerous U.S. patents, such as U.S. Pat. No. 4,265,990, the disclosure of which is totally incorporated herein by reference.

In U.S. Pat. No. 4,921,769, the disclosure of which is totally incorporated herein by reference, there are illustrated photoconductive imaging members with blocking layers of certain polyurethanes.

Illustrated in U.S. Pat. No. 5,473,064, the disclosure of which is totally incorporated herein by reference, is a process for the preparation of hydroxygallium phthalocyanine Type V, essentially free of chlorine.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments, which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake;

removing water from said slurry by azeotropic distillation with an organic solvent, and subjecting said resulting pigment slurry to mixing with the addition of a second solvent to cause the formation of said hydroxygallium phthalocyanine polymorphs.

A number of photoconductors are disclosed in U.S. Pat. No. 5,489,496; U.S. Pat. No. 4,579,801; U.S. Pat. No. 4,518,669; U.S. Pat. No. 4,775,605; U.S. Pat. No. 5,656,407; U.S. Pat. No. 5,641,599; U.S. Pat. No. 5,344,734; U.S. Pat. No. 5,721,080; and U.S. Pat. No. 5,017,449, the entire disclosures of which are totally incorporated herein by reference. Also, photoreceptors are disclosed in U.S. Pat. No. 6,200,716; U.S. Pat. No. 6,180,309; and U.S. Pat. No. 6,207,334, the entire disclosures of which are totally incorporated herein by reference.

A number of undercoat or charge blocking layers are disclosed in U.S. Pat. No. 4,464,450; U.S. Pat. No. 5,449,573; U.S. Pat. No. 5,385,796; and U.S. Pat. No. 5,928,824, the entire disclosures of which are totally incorporated herein by reference.

SUMMARY

According to embodiments illustrated herein, there are provided photoconductors that possess minimal light shock characteristics, enable acceptable print quality, and wherein ghosting is minimized or substantially eliminated in images printed in systems with high transfer current, and where charge deficient spots (CDS) resulting, for example, from the photogenerating layer, and causing printable defects is minimized, and more specifically, where the CDS are low, such as from about 30 to about 90 percent lower, as compared to a similar photoconductor with a known hole blocking layer.

Embodiments disclosed herein also include a photoconductor comprising a substrate, an undercoat layer as illustrated herein, disposed or deposited on the substrate, and a photogenerating layer and charge transport layer formed on the undercoat layer; a photoconductor comprised of a substrate, an undercoat layer disposed on the substrate, wherein the undercoat layer comprises a metal oxide like titanium dioxide, a polymer binder and an iron containing compound which primarily functions to inhibit light shock characteristics for the photoconductor.

DETAILED DESCRIPTION

Aspects of the present disclosure relate to a photoconductor comprising a substrate; an undercoat layer thereover wherein the undercoat layer comprises a metal oxide, and an iron containing compound; a photogenerating layer; and at least one charge transport layer; a photoconductor comprising a substrate; an undercoat layer thereover comprised of a mixture of a metal oxide, at least one resin binder, and an iron containing component; a photogenerating layer; and a charge transport layer; a rigid or flexible photoconductor comprising in sequence a supporting substrate; a hole blocking layer comprised of a titanium oxide, at least one polymer binder, and an iron containing compound; a photogenerating layer; and a charge transport layer; a photoconductive member or device comprising a substrate, the robust undercoat layer illustrated herein, and at least one imaging layer, such as a photogenerating layer and a charge transport layer or layers, formed on the undercoat layer; a photoconductor wherein the photogenerating layer is situated between the charge transport layer and the substrate, and which layer contains a resin binder; an electrophotographic imaging member which generally comprises at least a substrate layer, an undercoat layer, and where the undercoat layer is generally located between the substrate and, deposited on the undercoat layer in sequence, a photogenerating layer and a charge transport layer; a photoconductor comprising a substrate, an undercoat layer thereover wherein the undercoat layer comprises a metal oxide, and at least one iron containing compound, a photogenerating layer, and at least one charge transport layer; a photoconductor comprising a substrate, an undercoat layer thereover comprised of a mixture of a metal oxide, a resin binder, and an iron containing compound; a photogenerating layer; and a charge transport layer; and a rigid or flexible photoconductor comprising in sequence a supporting substrate, an iron containing hole blocking layer, a photogenerating layer, and at least one charge transport layer.

In embodiments, the undercoat layer metal oxide like $TiO_2$ can be either surface treated or untreated. Surface treatments include, but are not limited to, mixing the metal oxide with aluminum laurate, alumina, zirconia, silica, silane, methicone, dimethicone, sodium metaphosphate, and the like, and mixtures thereof. Examples of $TiO_2$ include MT-150W™ (surface treatment with sodium metaphosphate, available from Tayca Corporation), STR-60N™ (no surface treatment, available from Sakai Chemical Industry Co., Ltd.), FTL-100™ (no surface treatment, available from Ishihara Sangyo Laisha, Ltd.), STR-60™ (surface treatment with $Al_2O_3$, available from Sakai Chemical Industry Co., Ltd.), TTO-55N™ (no surface treatment, available from Ishihara Sangyo Laisha, Ltd.), TTO-55A™ (surface treatment with $Al_2O_3$, available from Ishihara Sangyo Laisha, Ltd.), MT-150AW™ (no surface treatment, available from Tayca Corporation), MT-150A™ (no surface treatment, available from Tayca Corporation), MT-100S™ (surface treatment with aluminum laurate and alumina, available from Tayca Corporation), MT-100HD™ (surface treatment with zirconia and alumina, available from Tayca Corporation), MT-100SA™ (surface treatment with silica and alumina, available from Tayca Corporation), and the like.

Examples of metal oxides present in suitable amounts, such as for example, from about 10 to about 80 weight percent, and more specifically, from about 40 to about 70 weight percent, are titanium oxides and mixtures of metal oxides thereof. In embodiments, the metal oxide has a size diameter of from about 5 to about 300 nanometers, a powder resistance of from about $1\times10^3$ to about $6\times10^5$ ohm/cm when applied at a pressure of from about 50 to about 650 kilograms/$cm^2$, and yet more specifically, the titanium oxide possesses a primary particle size diameter of from about 10 to about 25 nanometers, and more specifically, from about 12 to about 17, and yet more specifically, about 15 nanometers with an estimated aspect ratio of from about 4 to about 5, and is optionally surface treated with, for example, a component containing, for example, from about 1 to about 3 percent by weight of alkali metal, such as a sodium metaphosphate, a powder resistance of from about $1\times10^4$ to about $6\times10^4$ ohm/cm when applied at a pressure of from about 650 to about 50 kilograms/$cm^2$; MT-150W™, which titanium oxide is available from Tayca Corporation, and wherein the hole blocking layer is of a suitable thickness, such as a thickness of about from about 0.1 to about 15 microns, thereby avoiding or minimizing charge leakage. Metal oxide examples in addition to titanium are chromium, zinc, tin, copper, antimony, and the like, and more specifically, zinc oxide, tin oxide, aluminum oxide, silicone oxide, zirconium oxide, indium oxide, molybdenum oxide, and mixtures thereof.

A number of iron containing compounds can be selected for the hole blocking or undercoat layer, including known iron containing compounds substantially soluble in the solvent selected for deposition of the hole blocking layer.

In embodiments, examples of iron containing compounds include ferrocene, iron thiocarbamate, iron-nitrogen chelate, iron-oxygen chelate, iron-nitrogen-oxygen chelate, and the like, and mixtures thereof.

Examples of ferrocenes include 1,1'-diacetylferrocene, 1,1'-ferrocenedicarboxylic acid, (ferrocenylmethyl)trimethylammonium bromide, cyclopentadienyliron dicarbonyl dimer represented, for example, by the following formulas/structures

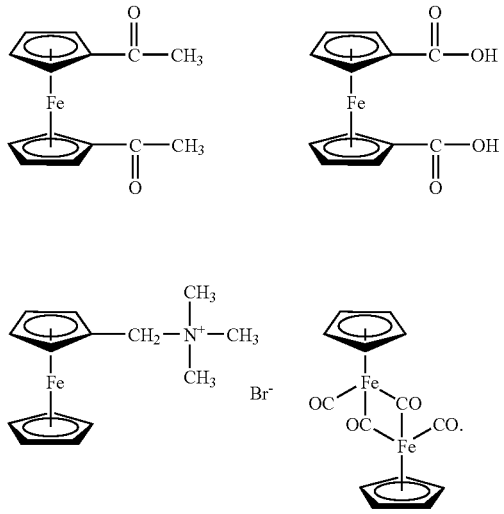

Examples of iron thiocarbamate include iron (III) diethyldithiocarbamate, iron (III) dimethyldithiocarbamate represented, for example, by the following formulas/structures

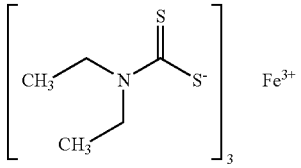

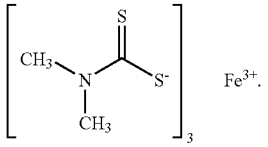

Iron-nitrogen chelate examples include iron phthalocyanine, hemin [chloro(protoporphyrinato) iron(III)] represented, for example, by the following formulas/structures

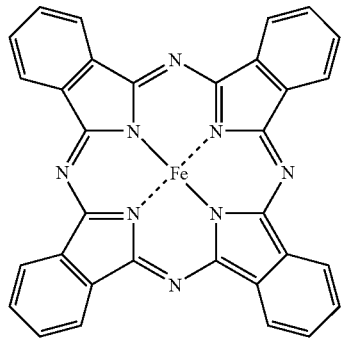

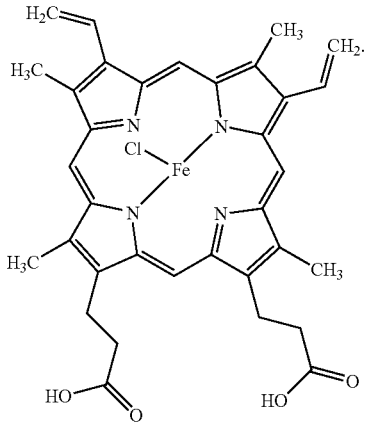

Examples of iron-oxygen chelates are iron (II) acetylacetonate, iron (III) acetylacetonate, tris(dibenzoylmethanato) iron, tris(hexafluoroacetylacetonato) iron (III), tris(trifluoro-2,4-pentanedionato) iron (III) represented, for example, by the following formulas/structures

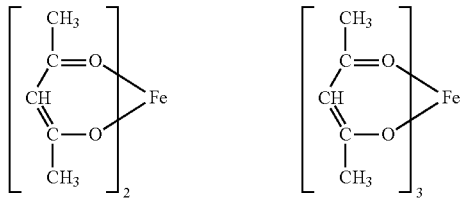

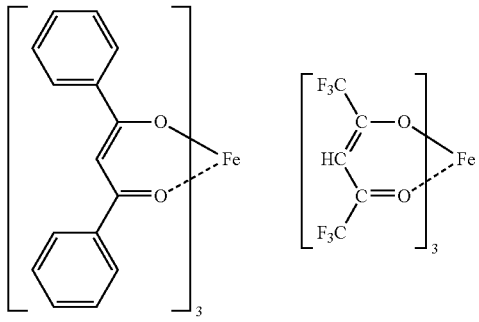

-continued

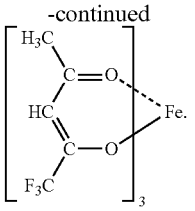

Iron-nitrogen-oxygen chelate examples include N,N'-disalicylal-ethylenediamine iron (II) represented, for example, by the following formula/structure

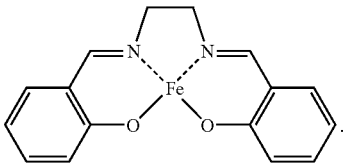

Examples of amounts of the iron containing compound that are present in the hole blocking later can vary, and be, for example, from about 0.01 to about 30 weight percent, from about 0.1 to about 20 weight percent, and from about 0.5 to about 10 weight percent based on the weight percentages of the components contained in the hole blocking layer.

There can be further included in the undercoat or hole blocking layer a number of polymer binders, such as phenolic resins, polyol resins such as acrylic polyol resins, polyacetal resins such as polyvinyl butyral resins, polyisocyanate resins, aminoplast resins such as melamine resins or mixtures of these resins, and which resins or mixtures of resins function primarily to disperse the metal oxide, the iron containing compound, and other components that may be present in the undercoat.

Polymer Binder Examples

In embodiments, acrylic polyol resin or acrylic examples include copolymers of derivatives of acrylic and methacrylic acid including acrylic and methacrylic esters and compounds containing nitrile and amide groups, and other optional monomers. The acrylic esters can be selected from, for example, the group consisting of n-alkyl acrylates wherein alkyl contains in embodiments from 1 to about 25 carbon atoms, such as methyl, ethyl, propyl, butyl, pentyl, hexyl, heptyl, octyl, nonyl, decyl, dodecyl, tetradecyl, or hexadecyl acrylate; secondary and branched-chain alkyl acrylates such as isopropyl, isobutyl, sec-butyl, 2-ethylhexyl, or 2-ethylbutyl acrylate; olefinic acrylates such as allyl, 2-methylallyl, furfuryl, or 2-butenyl acrylate; aminoalkyl acrylates such as 2-(dimethylamino)ethyl, 2-(diethylamino)ethyl, 2-(dibutylamino)ethyl, or 3-(diethylamino)propyl acrylate; ether acrylates such as 2-methoxyethyl 2-ethoxyethyl, tetrahydrofurfuryl, or 2-butoxyethyl acrylate; cycloalkyl acrylates such as cyclohexyl, 4-methylcyclohexyl, or 3,3,5-trimethylcyclohexyl acrylate; halogenated alkyl acrylates such as 2-bromoethyl, 2-chloroethyl, or 2,3-dibromopropyl acrylate; glycol acrylates and diacrylates such as ethylene glycol, propylene glycol, 1,3-propanediol, 1,4-butanediol, diethylene glycol, 1,5-pentanediol, triethylene glycol, dipropylene glycol, 2,5-hexanediol, 2,2-diethyl-1,3-propanediol, 2-ethyl-1,3-hexanediol, or 1,10-decanediol acrylate and diacrylate Examples of methacrylic esters can be selected from, for example, the group consisting of alkyl methacrylates such as methyl, ethyl, propyl, isopropyl, n-butyl, isobutyl, sec-butyl, t-butyl, n-hexyl, n-octyl, isooctyl, 2-ethylhexyl, n-decyl, or tetradecyl methacrylate; unsaturated alkyl methacrylates such as vinyl, allyl, oleyl, or 2-propynyl methacrylate, cycloalkyl methacrylates such as cyclohexyl, 1-methylcyclohexyl, 3-vinylcyclohexyl, 3,3,5-trimethylcyclohexyl, bornyl, isobornyl, or cyclopenta-2,4-dienyl methacrylate, aryl methacrylates such as phenyl, benzyl, or nonylphenyl methacrylate; hydroxyalkyl methacrylates such as 2-hydroxyethyl, 2-hydroxypropyl, 3-hydroxypropyl, or 3,4-dihydroxybutyl methacrylate; ether methacrylates such as methoxymethyl, ethoxymethyl, 2-ethoxyethoxymethyl, allyloxymethyl, benzyloxymethyl, cyclohexyloxymethyl, 1 ethoxyethyl, 2-ethoxyethyl, 2-butoxyethyl, 1-methyl-(2-vinyloxy)ethyl, methoxymethoxyethyl, methoxyethoxyethyl, vinyloxyethoxyethyl, 1-butoxypropyl, 1-ethoxybutyl, tetrahydrofurfuryl, or furfuryl methacrylate; oxiranyl methacrylates such as glycidyl, 2,3-epoxybutyl, 3,4-epoxybutyl, 2,3-epoxycyclohexyl, or 10,11-epoxyundecyl methacrylate; aminoalkyl methacrylates such as 2-dimethylaminoethyl, 2-diethylaminoethyl, 2-t octylaminoethyl, N,N-dibutylaminoethyl 3-diethylaminopropyl, 7-amino-3,4-dimethyloctyl, N-methylformamidoethyl, or 2-ureidoethyl methacrylate; glycol dimethacrylates such as methylene, ethylene glycol, 1,2-propanediol, 1,3-butanediol, 1,4-butanediol, 2,5-dimethyl-1,6-hexanediol, 1,10-decanediol, diethylene glycol, or triethylene glycol dimethacrylate; trimethacrylates such as trimethylolpropane trimethacrylate; carbonyl-containing methacrylates such as carboxymethyl, 2-carboxyethyl, acetonyl, oxazolidinylethyl, N-(2-methacryloyloxyethyl)-2-pyrrolidinone, N-methacryl-2-pyrrolidinone, N-(methacryloyloxy)formamide, N-methacryloylmorpholine or tris(2-methacryloxyethyl)amine methacrylate; other nitrogen-containing methacrylates such as 2-methacryloyloxyethylmethyl cyanamide, methacryloyloxyethyltrimethylammonium chloride, N-(methacryloyloxy-ethyl) diisobutylketimine, cyanomethyl, or 2-cyanoethyl methacrylate; halogenated alkyl methacrylates such as chloromethyl, 1,3-dichloro-2-propyl, 4-bromophenyl, 2-bromoethyl, 2,3-dibromopropyl, or 2-iodoethyl methacrylate; sulfur-containing methacrylates such as methylthiol, butylthiol, ethylsulfonylethyl, ethylsulfonylethyl, thiocyanatomethyl, 4-thiocyanatobutyl, methylsulfinylmethyl, 2-dodecylthioethyl methacrylate, or bis(methacryloyloxyethyl) sulfide; phosphorous-boron-silicon-containing methacrylates such as 2-(ethylenephosphino)propyl, dimethylphosphinomethyl, dimethylphosphonoethyl, diethylphosphatoethyl, 2-(dimethylphosphato)propyl, 2-(dibutylphosphono)ethyl methacrylate, diethyl methacryloylphosphonate, dipropyl methacryloyl phosphate, diethyl methacryloyl phosphite, 2-methacryloyloxyethyl diethyl phosphite, 2,3-butylene methacryloyl-oxyethyl borate, or methyldiethoxymethacryloyloxyethoxysilane. Methacrylic amides and nitriles can be selected from the group consisting of at least one of N-methylmethacrylamide, N-isopropylmethacrylamide, N-phenylmethacrylamide, N-(2-hydroxyethyl)methacrylamide, 1-methacryloylamido-2-methyl-2-propanol, 4-methacryloylamido-4-methyl-2-pentanol, N-(methoxymethyl)methacrylamide, N-(dimethylaminoethyl)methacrylamide, N-(3-dimethylaminopropyl)methacrylamide, N-acetylmethacrylamide, N-methacryloylmalemic acid, methacryloylamido acetonitrile, N-(2-cyanoethyl) methacrylamide, 1-methacryloylurea, N-phenyl-N-phenylethylmethacrylamide, N-(3-dibutylaminopropyl)methacrylamide, N,N-diethylmethacrylamide, N-(2-cyanoethyl)-N-methylmethacrylamide, N,N-bis(2-diethylaminoethyl) methacrylamide, N-methyl-N-phenylmethacrylamide, N,N'- methylenebismethacrylamide, N,N'-ethylenebismethacrylamide, or N-(diethylphosphono) methacrylamide. Further optional monomer examples are styrene, acrolein, acrylic anhydride, acrylonitrile, acryloyl chloride, methacrolein, methacrylonitrile, methacrylic anhydride, methacrylic acetic anhydride, methacryloyl chloride, methacryloyl bromide, itaconic acid, butadiene, vinyl chloride, vinylidene chloride, or vinyl acetate.

Further specific examples of acrylic polyol resins include PARALOID™ AT-410 (acrylic polyol, 73 percent in methyl amyl ketone, $T_g$=30° C., OH equivalent weight=880 acid number=25, $M_w$=9,000), AT-400 (acrylic polyol, 75 percent in methyl amyl ketone, $T_g$=15° C., OH equivalent weight=650, acid number=25, $M_w$=15,000), AT-746 (acrylic polyol, 50 percent in xylene, $T_g$=83° C., OH equivalent weight=1,700, acid number=15, $M_w$=45,000), AE-1285 (acrylic polyol, 68.5 percent in xylene/butanol=70/30, $T_g$=23° C., OH equivalent weight=1,185, acid number=49, $M_w$=6,500) and AT-63 (acrylic polyol, 75 percent in methyl amyl ketone, $T_g$=25° C., OH equivalent weight=1,300 acid number=30), all available from Rohm and Haas, Philadelphia Pa.; JONCRYL™ 500 (styrene acrylic polyol, 80 percent in methyl amyl ketone, $T_g$=−5° C., OH equivalent weight=400), 550 (styrene acrylic polyol, 62.5 percent in PM-acetate/toluene=65/35, OH equivalent weight=600), 551 (styrene acrylic polyol, 60 percent in xylene, OH equivalent weight=600), 580 (styrene acrylic polyol, $T_g$=50° C., OH equivalent weight=350, acid number=10, $M_w$=15,000), 942 (styrene acrylic polyol, 73.5 percent in n-butyl acetate, OH equivalent weight=400), and 945 (styrene acrylic polyol, 78 percent in n-butyl acetate, OH equivalent weight=310), all available from Johnson Polymer, Sturtevant, Wis.; RU-1100-1k™ with a $M_n$ of 1,000 and 112 hydroxyl value, and RU-1550-k5™ with a $M_n$ of 5,000 and 22.5 hydroxyl value, both available from Procachem Corp.; G-CURE™ 108A70, available from Fitzchem Corp.; NEOL® polyol, available from BASF; TONE™ 0201 polyol with a $M_n$ of 530, a hydroxyl number of 117, and acid number of <0.25, available from Dow Chemical Company.

Examples of polyisocyanate binders include toluene diisocyanate (TDI), diphenylmethane 4,4'-diisocyanate (MDI), hexamethylene diisocyanate (HDI), isophorone diisocyanate (IPDI) based aliphatic and aromatic polyisocyanates. MDI is also known as methylene bisphenyl isocyanate. Toluene diisocyanate (TDI), $CH_3(C_6H_3)(NCO)_2$, can be comprised of two common isomers, the 2,4 and the 2,6 diisocyanate, the pure (100 percent) 2,4 isomer is available and is used commercially, however, a number of TDIs are sold as 80/20 or 65/35 2,4/2,6 blends. Diphenylmethane 4,4' diisocyanate (MDI) is $OCN(C_6H_4)CH_2(C_6H_4)NCO$, and where the pure product has a functionality of 2, it being common to blend pure material with mixtures of higher functionality MDI oligomers (often known as crude MDI) to create a range of functionalities/crosslinking potential. Hexamethylene diisocyanate (HDI) is $OCN(CH_2)_6NCO$, and isophorone diisocyanate (IPDI) is $OCNC_6H_7(CH_3)_3CH_2NCO$. For blocked polyisocyanates, typical blocking agents used include malonates, triazoles, ϵ-caprolactam, sulfites, phenols, ketoximes, pyrazoles, alcohols, and mixtures thereof; DESMODUR™ N3200 (aliphatic polyisocyanate resin based on HDI, 23 percent NCO content), N3300A (polyfunctional aliphatic isocyanate resin based on HDI, 21.8 percent NCO content), N75BA (aliphatic polyisocyanate resin based on HDI, 16.5 percent NCO content, 75 percent in n-butyl acetate), CB72N (aromatic polyisocyanate resin based on TDI, 12.3 to 13.3 percent NCO content, 72 percent in methyl n-amyl ketone), CB60N (aromatic polyisocyanate resin based on TDI, 10.3 to 11.3 percent NCO content, 60 percent in propylene glycol monomethyl ether acetate/xylene=5/3), CB601N (aromatic polyisocyanate resin based on TDI, 10 to 11 percent NCO content, 60 percent in propylene glycol monomethyl ether acetate), CB55N (aromatic polyisocyanate resin based on TDI, 9.4 to 10.2 percent NCO content, 55 percent in methyl ethyl ketone), BL4265SN (blocked aliphatic polyisocyanate resin based on IPDI, 8.1 percent blocked NCO content, 65 percent in aromatic 100), BL3475BA/SN (blocked aliphatic polyisocyanate resin based on HDI, 8.2 percent blocked NCO content, 75 percent in aromatic 100/n-butyl acetate=1/1), BL3370MPA (blocked aliphatic polyisocyanate resin based on HDI, 8.9 percent blocked NCO content, 70 percent in propylene glycol monomethyl ether acetate), BL3272MPA (blocked aliphatic polyisocyanate resin based on HDI, 10.2 percent blocked NCO content, 72 percent in propylene glycol monomethyl ether acetate), BL3175A (blocked aliphatic polyisocyanate resin based on HDI, 11.1 percent blocked NCO content, 75 percent in aromatic 100), MONDUR™ M (purified MDI supplied in flaked, fused or molten form), CD (modified MDI, liquid at room temperature, 29 to 30 percent NCO content), 582 (medium-functionality polymeric MDI, 32.2 percent NCO content), 448 (modified polymeric MDI prepolymer, 27.1 to 28.1 percent NCO content), 1441 (aromatic polyisocyanate based on MDI, 24.5 percent NCO content), 501 (MDI-terminated polyester prepolymer, 18.7 to 19.1 percent NCO content), all available from Bayer Polymers, Pittsburgh, Pa.

In embodiments, aminoplast resin refers, for example, to a type of amino resin generated from a nitrogen-containing substance and formaldehyde, wherein the nitrogen-containing substance includes, for example, melamine, urea, benzoguanamine and glycoluril. Melamine resins are considered amino resins prepared from melamine and formaldehyde. Melamine resins are known under various trade names, including but not limited to CYMEL®, BEETLE™, DYNOMIN™, BECKAMINE™, UFR™, BAKELITE™, ISOMIN™, MELAICAR™, MELBRITE™, MELMEX™, MELOPAS™, RESART™, and ULTRAPAS™. As used herein, urea resins are amino resins made from urea and formaldehyde. Urea resins are known under various trade names, including but not limited to CYMEL®, BEETLE™, UFRM, DYNOMIN™, BECKAMINE™, and AMIREME™.

In various embodiments, the melamine resin can be represented by

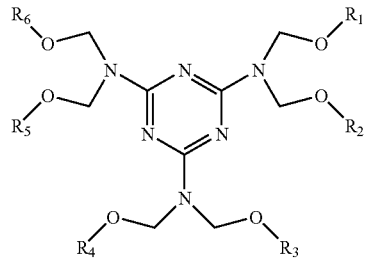

wherein $R_1$, $R_2$, $R_3$, $R_4$, $R_5$ and $R_6$ each independently represents a hydrogen atom or an alkyl chain with, for example, from 1 to about 8 carbon atoms, and more specifically, from 1 to about 4 carbon atoms. In embodiments, the melamine resin is water soluble, dispersible or nondispersible. Specific examples of melamine resins include highly alkylated/alkoxylated, partially alkylated/alkoxylated, or mixed alkylated/alkoxylated; methylated, n-butylated or isobutylated; highly methylated melamine resins such as CYMEL® 350, 9370; methylated high imino melamine resins (partially methylolated and highly alkylated) such as CYMEL® 323, 327; partially methylated melamine resins (highly methylolated and partially methylated) such as CYMEL® 373, 370; high solids mixed ether melamine resins such as CYMEL® 1130, 324; n-butylated melamine resins such as CYMEL® 1151, 615; n-butylated high imino melamine resins such as CYMEL® 1158; iso-butylated melamine resins such as CYMEL® 255-10. CYMEL® melamine resins are commercially available from CYTEC Industries Inc., and yet more specifically, the melamine resin may be selected from the group consisting of methylated formaldehyde-melamine resin, methoxymethylated melamine resin, ethoxymethylated melamine resin, propoxymethylated melamine resin, butoxymethylated melamine resin, hexamethylol melamine resin, alkoxyalkylated melamine resins such as methoxymethylated melamine resin, ethoxymethylated melamine resin, propoxymethylated melamine resin, butoxymethylated melamine resin, and mixtures thereof.

Examples of urea resin binders can be represented by

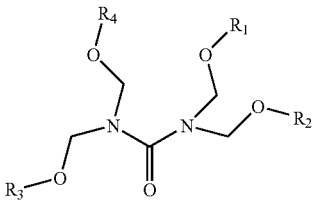

wherein $R_1$, $R_2$, $R_3$, and $R_4$ each independently represents a hydrogen atom, an alkyl chain with, for example, from 1 to about 8 carbon atoms, or with 1 to 4 carbon atoms, and which urea resin can be water soluble, dispersible or indispersible. The urea resin can be a highly alkylated/alkoxylated, partially alkylated/alkoxylated, or mixed alkylated/alkoxylated, and more specifically, the urea resin is a methylated, n-butylated or isobutylated polymer. Specific examples of the urea resin include methylated urea resins such as CYMEL® U-65, U-382; n-butylated urea resins such as CYMEL® U-1054, UB-30-B; iso-butylated urea resins such as CYMEL® U-662, UI-19-I. CYMEL® urea resins are commercially available from CYTEC Industries Inc.

Examples of benzoguanamine binder resins can be represented by

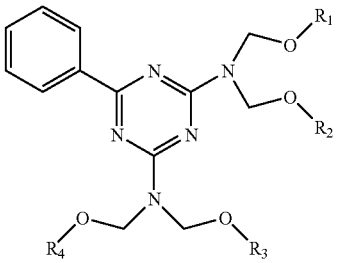

wherein $R_1$, $R_2$, $R_3$, and $R_4$ each independently represents a hydrogen atom or an alkyl chain as illustrated herein. In embodiments, the benzoguanamine resin is water soluble, dispersible or indispersible. The benzoguanamine resin can be highly alkylated/alkoxylated, partially alkylated/alkoxylated, or a mixed alkylated/alkoxylated material. Specific examples of the benzoguanamine resin include methylated, n-butylated or isobutylated, with examples of the benzoguanamine resin being CYMEL® 659, 5010, 5011. CYMEL® benzoguanamine resins are commercially available from CYTEC Industries Inc. Benzoguanamine resin examples can be generally comprised of amino resins generated from benzoguanamine and formaldehyde. Benzoguanamine resins are known under various trade names, including but not limited to CYMEL®, BEETLE™, and UFORMITE™. Glycoluril resins are amino resins obtained from glycoluril and formaldehyde and are known under various trade names, including but not limited to CYMEL®, and POWDERLINK™. The aminoplast resins can be highly alkylated or partially alkylated.

In various embodiments, the glycoluril resin binder is

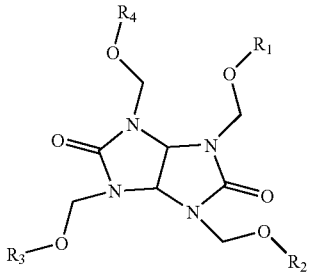

wherein $R_1$, $R_2$, $R_3$, and $R_4$ each independently represents a hydrogen atom or an alkyl chain as illustrated herein with, for example, 1 to about 8 carbon atoms, or with 1 to about 4 carbon atoms. The glycoluril resin can be water soluble, dispersible or indispersible. Examples of the glycoluril resin include highly alkylated/alkoxylated, partially alkylated/alkoxylated, or mixed alkylated/alkoxylated, and more specifically, the glycoluril resin can be methylated, n-butylated, or isobutylated. Specific examples of the glycoluril resin include CYMEL® 1170, 1171. CYMEL® glycoluril resins are commercially available from CYTEC Industries Inc.

Phenolic resin binders can be formed from the condensation products of an aldehyde with a phenol source in the presence of an acidic or basic catalyst.

The phenol source may be, for example, phenol, alkyl-substituted phenols such as cresols and xylenols, halogen-substituted phenols such as chlorophenol, polyhydric phenols such as resorcinol or pyrocatechol, polycyclic phenols such as naphthol and bisphenol A, aryl-substituted phenols, cycloalkyl-substituted phenols, aryloxy-substituted phenols, and combinations thereof. The phenol source may be, for example, phenol, 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, p-phenoxy phenol, multiple ring phenols, such as bisphenol A, and combinations thereof. The aldehyde may be, for example, formaldehyde, paraformaldehyde, acetaldehyde, butyraldehyde, paraldehyde, glyoxal, furfuraldehyde, propionaldehyde, benzaldehyde, and combinations thereof. The phenolic resin may be, for example, selected from dicyclopentadiene type phenolic resins, phenol novolak resins, cresol novolak resins, phenol aralkyl resins, and combinations thereof. U.S. Pat. Nos.

6,255,027, 6,177,219, and 6,156,468, the disclosures of which are totally incorporated herein by reference, illustrate examples of hole blocking layer of a plurality of light scattering particles dispersed in a binder such as a hole blocking layer of titanium dioxide dispersed in a specific linear phenolic binder of VARCUM® (available from OxyChem Company). Examples of phenolic resins include, but are not limited to, formaldehyde polymers with phenol, p-tert-butylphenol, and cresol, such as VARCUM™ 29159 and 29101 (OxyChem Co.) and DURITE™ 97 (Borden Chemical), or formaldehyde polymers with ammonia, cresol, and phenol, such as VARCUM™ 29112 (OxyChem Co.), or formaldehyde polymers with 4,4'-(1-methylethylidene) bisphenol such as VARCUM™ 29108 and 29116 (OxyChem Co.), or formaldehyde polymers with cresol and phenol such as VARCUM™ 29457 (OxyChem Co.), DURITE™ SD-423A, SD-422A (Borden Chemical), or formaldehyde polymers with phenol and p-tert-butylphenol such as DURITE™ ESD 556C (Border Chemical).

The phenolic resins can be used as purchased, or they can be modified to enhance certain properties. For example, the phenolic resins can be modified with suitable plasticizers, including but not limited to polyvinyl butyral, polyvinyl formal, alkyds, epoxy resins, phenoxy resins (bisphenol A, epichlorohydrin polymer), polyamides, oils, and the like.

In embodiments, polyacetals resin binders include polyvinyl butyrals, formed by the well known reactions between aldehydes and alcohols. The addition of one molecule of an alcohol to one molecule of an aldehyde produces a hemiacetal. Hemiacetals are rarely isolated because of their inherent instability, but rather are further reacted with another molecule of alcohol to form a stable acetal. Polyvinyl acetals are prepared from aldehydes and polyvinyl alcohols. Polyvinyl alcohols are high molecular weight resins containing various percentages of hydroxyl and acetate groups produced by hydrolysis of polyvinyl acetate. The conditions of the acetal reaction and the concentration of the particular aldehyde and polyvinyl alcohol used are controlled to form polymers containing predetermined proportions of hydroxyl groups, acetate groups, and acetal groups. The polyvinyl butyral can be represented by

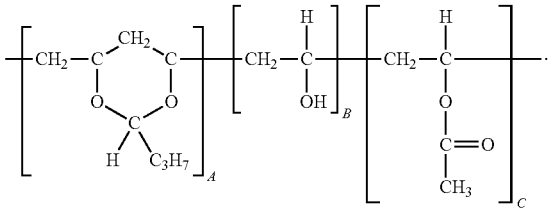

The proportions of polyvinyl butyral (A), polyvinyl alcohol (B), and polyvinyl acetate (C) are controlled, and they are randomly distributed along the molecule. The mole percent of polyvinyl butyral (A) is from about 50 to about 95, that of polyvinyl alcohol (B) is from about 5 to about 30, and that of polyvinyl acetate (C) is from about 0 to about 10. In addition to vinyl butyral (A), other vinyl acetals can be optionally present in the molecule including vinyl isobutyral (D), vinyl propyral (E), vinyl acetacetal (F), and vinyl formal (G). The total mole percent of all the monomeric units in one molecule is 100.

Examples of polyvinyl butyrals include BUTVAR™ B-72 ($M_w$=170,000 to 250,000, A=80, B=17.5 to 20, C=0 to 2.5), B-74 ($M_w$=120,000 to 150,000, A=80, B=17.5 to 20, C=0 to 2.5), B-76 ($M_w$=90,000 to 120,000, A=88, B=11 to 13, C=0 to 1.5), B-79 ($M_w$=50,000 to 80,000, A=88, B=10.5 to 13, C=0 to 1.5), B-90 ($M_w$=70,000 to 100,000, A=80, B=18 to 20, C=0 to 1.5), and B-98 ($M_w$=40,000 to 70,000, A=80, B=18 to 20, C=0 to 2.5), all commercially available from Solutia, St. Louis, Mo.; S-LEC™ BL-1 (degree of polymerization=300, A=63±3, B=37, C=3), BM-1 (degree of polymerization=650, A=65±3, B=32, C=3), BM-S (degree of polymerization=850, A>=70, B=25, C=4 to 6), BX-2 (degree of polymerization=1,700, A=45, B=33, G=20), all commercially available from Sekisui Chemical Co., Ltd., Tokyo, Japan.

The hole blocking layer can contain a single resin binder, a mixture of resin binders, such as from 2 to about 7, and the like, and where for the mixtures the percentage amounts selected for each resin varies providing that the mixture contains about 100 percent by weight of the first and second resin, or the first, second, and third resin.

The hole blocking layer can, in embodiments, be prepared by a number of known methods, the process parameters being dependent, for example, on the photoconductor member desired. The hole blocking layer can be coated as solution or a dispersion onto a substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 1 minute to about 10 hours, under stationary conditions or in an air flow. The coating can be accomplished to provide a final coating thickness of from about 0.1 to about 30 microns, or from about 0.5 to about 15 microns after drying.

Photoconductor Layer Examples

In embodiments, the undercoat layer may contain various colorants such as organic pigments and organic dyes, including, but not limited to, azo pigments, quinoline pigments, perylene pigments, indigo pigments, thioindigo pigments, bisbenzimidazole pigments, phthalocyanine pigments, quinacridone pigments, quinoline pigments, lake pigments, azo lake pigments, anthraquinone pigments, oxazine pigments, dioxazine pigments, triphenylmethane pigments, azulenium dyes, squalium dyes, pyrylium dyes, triallylmethane dyes, xanthene dyes, thiazine dyes, and cyanine dyes. In various embodiments, the undercoat layer may include inorganic materials, such as amorphous silicon, amorphous selenium, tellurium, a selenium-tellurium alloy, cadmium sulfide, antimony sulfide, titanium oxide, tin oxide, zinc oxide, and zinc sulfide, and mixtures thereof. The colorant can be selected in various suitable amounts like from about 0.5 to about 20 weight percent, and more specifically, from 1 to about 12 weight percent.

The thickness of the photoconductive substrate layer depends on many factors including economical considerations, electrical characteristics, and the like; thus, this layer may be of a substantial thickness, for example over 3,000 microns, such as from about 500 to about 2,000, from about 300 to about 700 microns, or of a minimum thickness. In embodiments, the thickness of this layer is from about 75 microns to about 300 microns, or from about 100 to about 150 microns.

The substrate may be opaque or substantially transparent, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors including strength desired and economical considerations. For a drum, as disclosed in a copending application referenced herein, this layer may be of substantial thickness of, for example, up to many centimeters or of a minimum thickness of less than a millimeter. Similarly, a flexible belt may be of a substantial thickness of, for example, about 250 micrometers, or of minimum thickness of less than about 50 micrometers, provided there are no adverse effects on the final electrophotographic device. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, substrates selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer in embodiments is comprised of, for example, a number of known photogenerating pigments including, for example, Type V hydroxygallium phthalocyanine, Type IV or V titanyl phthalocyanine or chlorogallium phthalocyanine, and a resin binder like poly(vinyl chloride-co-vinyl acetate) copolymer, such as VMCH (available from Dow Chemical), or polycarbonate. Generally, the photogenerating layer can contain known photogenerating pigments, such as metal phthalocyanines, metal free phthalocyanines, alkylhydroxylgallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations. The photogenerating layer binder resin is present in various suitable amounts of, for example, from about 1 to about 50, and more specifically, from about 1 to about 10 weight percent, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicone and compounds of silicone and germanium, carbon, oxygen, nitrogen, and the like fabricated by vacuum evaporation or deposition. The photogenerating layer may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

Examples of polymeric binder materials that can be selected as the matrix for the photogenerating layer components include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

Various suitable and conventional known processes may be selected to mix, and thereafter apply the photogenerating layer coating mixture to the substrate or other layers like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like. The coating of the photogenerating layer on the UCL (undercoat layer) in embodiments of the present disclosure can be accomplished such that the final dry thickness of the photogenerating layer is as illustrated herein, and can be, for example, from about 0.01 to about 30 microns after being dried at, for example, about 40° C. to about 150° C. for about 1 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. The hole blocking layer or UCL may be applied to the electrically conductive supporting substrate surface prior to the application of a photogenerating layer.

A suitable known adhesive layer can be included in the photoconductor. Typical adhesive layer materials include, for example, polyesters, polyurethanes, and the like. The adhesive layer thickness can vary, and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like. As optional adhesive layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicone nitride, carbon black, and the like, to provide, for example, in embodiments of the present disclosure, further desirable electrical and optical properties.

A number of charge transport materials, especially known hole transport molecules, may be selected for the charge transport layer, examples of which are aryl amines of the formulas/structures, and which layer is generally of a thickness of from about 5 microns to about 75 microns, and more specifically, of a thickness of from about 10 microns to about 40 microns

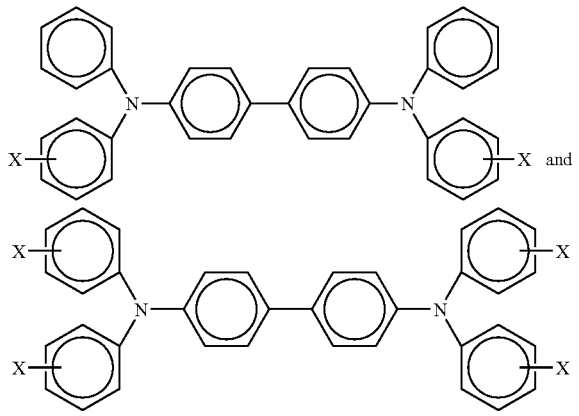

wherein X is a suitable hydrocarbon like alkyl, alkoxy, and aryl; a halogen, or mixtures thereof, and especially those substituents selected from the group consisting of Cl and $CH_3$; and molecules of the following formulas

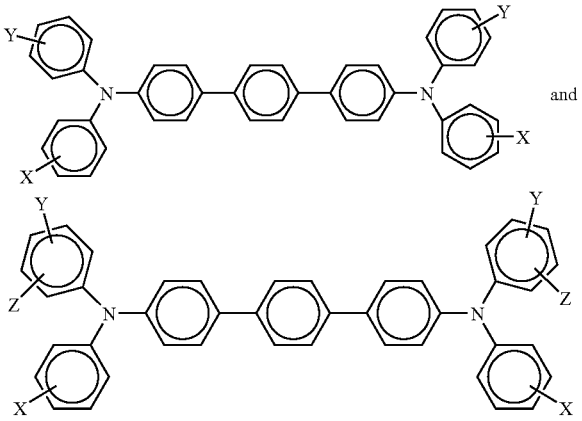

wherein X, Y and Z are a suitable substituent like a hydrocarbon, such as independently alkyl, alkoxy, or aryl; a halogen, or mixtures thereof, and wherein at least one of Y or Z is present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments. At least one charge transport refers, for example, to 1, from 1 to about 7, from 1 to about 4, and from 1 to about 2.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"- diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layer or layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly (cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carboxyl hydrazone, and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material or a combination of a small molecule charge transport material and a polymeric charge transport material.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ PS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

A number of processes may be used to mix, and thereafter apply the charge transport layer or layers coating mixture to the photogenerating layer. Typical application techniques include spraying, dip coating, and roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is, for example, from about 10 to about 75, from about 15 to about 50 micrometers, but thicknesses outside these ranges may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to about 200:1, and in some instances 400:1.

The charge transport layer is substantially nonabsorbing to visible light or radiation in the region of intended use, but is electrically "active" in that it allows the injection of photogenerated holes from the photoconductive layer or photogenerating layer, and allows these holes to be transported to selectively discharge a surface charge on the surface of the active layer.

The thickness of the continuous charge transport layer selected depends upon the abrasiveness of the charging (bias charging roll), cleaning (blade or web), development (brush), transfer (bias transfer roll), and the like in the system employed, and can be up to about 10 micrometers. In embodiments, the thickness for each charge transport layer can be, for example, from about 1 micrometer to about 5 micrometers. Various suitable and conventional methods may be used to mix, and thereafter apply an overcoat top charge transport layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration. Free carrier concentration in the overcoat increases the dark decay.

The following Examples are provided. All proportions are by weight unless otherwise indicated.

Comparative Example 1

A dispersion of a hole blocking layer was prepared by milling 18 grams of $TiO_2$ (MT-150W, manufactured by Tayca Co., Japan), 24 grams of a phenolic resin (VARCUM® 29159, OxyChem Co.) at a solid weight ratio of about 60 to about 40 in a solvent of about 50 to about 50 in weight of xylene and 1-butanol, and a total solid content of about 52 percent in an Attritor mill with about 0.4 to about 0.6 millimeter size $ZrO_2$ beads for 6.5 hours, and then filtering with a 20 μm Nylon filter. To the resulting dispersion was then added methyl isobutyl ketone in a solvent mixture of xylene, and 1-butanol at a weight ratio of 47.5:47.5:5 (xylene:butanol:ketone). A 30 millimeter aluminum drum substrate was then coated with the aforementioned generated dispersion using known coating techniques as illustrated herein. After drying a hole blocking layer of $TiO_2$ in the phenolic resin ($TiO_2$/phenolic resin=60/40), about 10 microns in thickness were obtained.

A photogenerating layer comprising chlorogallium phthalocyanine (Type B) was deposited on the above hole blocking layer or undercoat layer at a thickness of about 0.2 micron. The photogenerating layer coating dispersion was prepared as follows: 2.7 grams of chlorogallium phthalocyanine (ClGaPc) Type B pigment were mixed with 2.3 grams of the polymeric binder (carboxyl-modified vinyl copolymer, VMCH, Dow Chemical Company), 15 grams of n-butyl acetate, and 30 grams of xylene. The resulting mixture was milled in an Attritor mill with about 200 grams of 1 millimeter Hi-Bea borosilicate glass beads for about 3 hours. The dispersion mixture obtained was then filtered through a 20 μm Nylon cloth filter, and the solids content of the dispersion was diluted to about 6 weight percent.

Subsequently, a 32 micron charge transport layer was coated on top of the photogenerating layer from a dispersion prepared from N,N'-diphenyl-N,N-bis(3-methylphenyl)-1,1'-biphenyl-4,4'-diamine (5.38 grams), a film forming polymer binder PCZ 400 [poly(4,4'-dihydroxy-diphenyl-1-1-cyclohexane, $M_w$=40,000)] available from Mitsubishi Gas Chemical Company, Ltd. (7.13 grams), and PTFE POLYFLON™ L-2 microparticle (1 gram) available from Daikin Industries dissolved/dispersed in a solvent mixture of 20 grams of tetrahydrofuran (THF) and 6.7 grams of toluene via a CAVIPRO™ 300 nanomizer (Five Star Technology, Cleveland, Ohio). The charge transport layer was dried at about 120° C. for about 40 minutes.

Example I

A photoconductor was prepared by repeating the process of Comparative Example 1 except that the hole blocking layer dispersion was prepared by further adding 0.3 gram, or 1 weight percent of iron (II) acetylacetonate into the hole blocking layer dispersion of Comparative Example 1, followed by mixing for 8 hours. A 30 millimeter aluminum drum substrate was coated using known coating techniques with the aforementioned formed dispersion. After drying a hole blocking layer of $TiO_2$ and iron (II) acetylacetonate in the phenolic resin ($TiO_2$/phenolic resin/iron (II) acetylacetonate=60/40/1), about 10 microns in thickness were obtained.

Example II

A photoconductor was prepared by repeating the process of Comparative Example 1 except that the hole blocking layer dispersion was prepared by further adding 0.3 gram, or 1 weight percent of iron (III) acetylacetonate into the hole blocking layer dispersion of Comparative Example 1, followed by mixing for 8 hours. A 30 millimeter aluminum drum substrate was coated using known coating techniques with the aforementioned formed dispersion. After drying a hole blocking layer of $TiO_2$ and iron (III) acetylacetonate in the phenolic resin ($TiO_2$/phenolic resin/iron (III) acetylacetonate=60/40/1), about 10 microns in thickness were obtained.

Example III

A photoconductor is prepared by repeating the process of Comparative Example 1 except that the hole blocking layer dispersion is prepared by further adding 0.6 gram, or 2 weight percent of 1,1'-diacetylferrocene into the hole blocking layer dispersion of Comparative Example 1, followed by mixing for 8 hours. A 30 millimeter aluminum drum substrate is coated using known coating techniques with the aforementioned formed dispersion. After drying a hole blocking layer of $TiO_2$ and 1,1'-diacetylferrocene in the phenolic resin ($TiO_2$/phenolic resin/1,1'-diacetylferrocene=60/40/2), about 10 microns in thickness are obtained.

Example IV

A photoconductor is prepared by repeating the process of Comparative Example 1 except that the hole blocking layer dispersion is prepared by further adding 1.5 grams, or 5 weight percent of iron (III) diethyldithiocarbamate into the hole blocking layer dispersion of Comparative Example 1, followed by mixing for 8 hours. A 30 millimeter aluminum drum substrate is coated using known coating techniques with the aforementioned formed dispersion. After drying a hole blocking layer of $TiO_2$ and iron (III) diethyldithiocarbamate in the phenolic resin ($TiO_2$/phenolic resin/iron (III) diethyldithiocarbamate=60/40/5), about 10 microns in thickness are obtained.

Example V

A photoconductor is prepared by repeating the process of Comparative Example 1 except that the hole blocking layer dispersion is prepared by further adding 3 grams, or 10 weight percent of hemin, chloro(protoporphyrinato) iron(III) into the hole blocking layer dispersion of Comparative Example 1, followed by mixing for 8 hours. A 30 millimeter aluminum drum substrate is coated using known coating techniques with the aforementioned formed dispersion. After drying a hole blocking layer of $TiO_2$ and hemin in the phenolic resin ($TiO_2$/phenolic resin/hemin=60/40/10), about 10 microns in thickness are obtained.

Example VI

A photoconductor is prepared by repeating the process of Comparative Example 1 except that the hole blocking layer dispersion is prepared by further adding 1.2 grams, or 4 weight percent of N,N'-disalicylal-ethylenediamine iron (II) into the hole blocking layer dispersion of Comparative Example 1, followed by mixing for 8 hours. A 30 millimeter aluminum drum substrate is coated using known coating techniques with the aforementioned formed dispersion. After drying a hole blocking layer of $TiO_2$ and N,N'-disalicylal-ethylenediamine iron (II) in the phenolic resin ($TiO_2$/phenolic resin/N,N'-disalicylal-ethylenediamine iron (II)=60/40/4), about 10 microns in thickness are obtained.

Electrical Property Testing

The above prepared photoconductors of Comparative Example 1 and Examples I and II were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The three photoconductors were tested at surface potentials of 700 volts with the exposure light intensity incrementally increased by regulating a series of neutral density filters; the exposure light source was a 780 nanometer light emitting diode. The xerographic simulation was completed in an environmentally controlled light tight chamber at ambient conditions (40 percent relative humidity and 22° C.).

The photoconductors of Comparative Examples 1 and Examples I and II exhibited substantially identical PIDCs. Thus, incorporation of the iron containing compound into the hole blocking layer did not adversely affect the PIDC.

Light Shock Reduction

An in-house light shock test was performed for the above-prepared photoconductor devices (Comparative Example 1, Examples I and II). The top half (50 percent) of each of the above-prepared photoconductors was exposed in a lab made small box with a 3,000 lux white exposure for 3 minutes, and the PIDCs were measured after 5 minutes and after 24 hours. As comparison, the bottom half of the photoconductor was shielded by black paper during the above light exposure, and the PIDCs of the bottom halves were also measured. The light shock results are summarized in Table 1.

TABLE 1

| V(2.65 ergs/cm$^2$) (V) | Shielded Bottom Half | Exposed Top Half (5 Minutes After Exposure) | Exposed Top Half (24 Hours After Exposure) |
|---|---|---|---|
| Comparative Example 1 | 258 | 220 | 223 |
| Example I | 254 | 216 | 230 |
| Example II | 241 | 223 | 227 |

V(2.65 ergs/cm$^2$) was the surface potential of the photoconductor when the exposure was 2.65 ergs/cm$^2$, and was used to characterize the photoconductor. When the above Table 1 drum devices were exposed from a white light, V(2.65 ergs/cm$^2$) was reduced immediately after exposure, for example 5 minutes after, and then the photoconductor tended to recover from this surface potential drop by the light exposure [increase in V(2.65 ergs/cm$^2$)] after a period of rest, for example 24 hours after.

The disclosed photoconductor device (Example I) exhibited a 38 volt initial decrease in V(2.65 ergs/cm$^2$), and the disclosed photoconductor device (Example II) exhibited a 18 volt initial decrease in V(2.65 ergs/cm$^2$), as compared to the controlled photoconductor device (Comparative Example 1) which exhibited a 38 volt initial decrease in V(2.65 ergs/cm$^2$) after 5 minutes. After 24 hours in a resting condition, the photoconductor devices recovered from the light shock, and more specifically, the disclosed photoconductor device (Example I) exhibited a 14 volt increase in V(2.65 ergs/cm$^2$), and the disclosed photoconductor device (Example II) exhibited a 4V increase in V(2.65 ergs/cm$^2$), as compared to the controlled photoconductor device (Comparative Example 1), an exhibited 3V increase in V(2.65 ergs/cm$^2$). The disclosed Example II photoconductor with the iron (III) acetylacetonate incorporated into the hole blocking layer exhibited significantly less light shock than the controlled Comparative Example 1 immediately after light exposure with less initial decrease in V(2.65 ergs/cm$^2$), however, the Example II photoconductor recovered at a similar rate as the control photoconductor of Comparative Example 1 with a similar increase in V(2.65 ergs/cm$^2$) after 24 hours of rest. As comparison, the disclosed Example I with iron (II) acetylacetonate incorporated into the hole blocking layer exhibited similar light shock to the controlled Comparative Example 1 immediately after light exposure with a similar initial decrease in V(2.65 ergs/cm$^2$), however, the Example I photoconductor recovered four times faster (14 volt increase versus 3 volt increase in V(2.65)) than the control with more increase in V(2.65 ergs/cm$^2$) after the 24 hour rest period.

Thus, incorporation of the iron containing compound, such as iron (III) acetylacetonate, in the hole blocking layer improved light shock resistance with the initial drop in V(2.65 ergs/cm$^2$) being about one half of that of the Comparative Example 1 photoconductor with no iron containing compound in the hole blocking layer. Furthermore, incorporation of the iron containing compound, such as iron (II) acetylacetonate, in the hole blocking layer improved light shock resistance with faster recovery from light shock than the Comparative Example 1 photoconductor.

For a number of photoconductors the V(2.65 ergs/cm$^2$) should remain unchanged whether the photoconductor is exposed to light or not. V(2.65 ergs/cm$^2$) usually drops or decreases after light exposure, and then increases after recovering in a resting posture. A light shock resistant photoconductor exhibits less initial drop in V(2.65 ergs/cm$^2$) as illustrated for the Example II photoconductor, 18 volts for the disclosed Example II photoconductor versus 38 volts for the control. Close to a 0V (0 volt) drop is considered to be desirable.

Light shock usually causes dark bands in developed prints from the light exposed photoconductor area at t=0 (time equals zero). A light shock resistant photoconductor is substantially free from print dark bands even after the photoconductor is exposed to light.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a substrate; an undercoat layer thereover wherein the undercoat layer comprises a metal oxide, and an iron containing compound selected from the group consisting of at least one of iron (III) diethyldithiocarbamate, iron (III) dimethyldithiocarbamate, and N,N'-disalicylal-ethylenediamine iron (II);

a photogenerating layer; and at least one charge transport layer.

2. A photoconductor in accordance with claim 1 wherein said undercoat layer further includes at least one polymer binder.

3. A photoconductor in accordance with claim 1 wherein said metal oxide is a titanium oxide.

4. A photoconductor in accordance with claim 1 wherein said metal oxide is present in an amount of from about 20 percent to about 80 percent by weight of the total weight of the undercoat layer components, and further which undercoat layer includes at least one resin binder.

5. A photoconductor in accordance with claim 1 wherein said iron containing compound is present in an amount of from about 0.01 to about 30 weight percent, and wherein the total of said components in said undercoat layer is about 100 percent.

6. A photoconductor in accordance with claim 1 wherein said iron containing compound is present in said undercoat layer in an amount of from about 0.1 to about 20 weight percent.

7. A photoconductor in accordance with claim 1 wherein said iron containing compound is present in said undercoat layer in an amount of from about 0.5 to about 10 weight percent.

8. A photoconductor in accordance with claim 1 wherein said iron compound is present in an amount of from about 0.1 to about 5 weight percent, and wherein said undercoat layer further contains a phenolic resin binder.

9. A photoconductor in accordance with claim 1 wherein said metal oxide is present in an amount of from about 10 percent to about 70 percent based on the total weight of the undercoat layer components.

10. A photoconductor in accordance with claim 1 wherein said metal oxide possesses a size diameter of from about 5 to about 300 nanometers, and a powder resistivity of from about $1\times10^3$ to about $1\times10^8$ ohm/cm when applied at a pressure of from about 50 to about 650 kilograms/cm$^2$.

11. A photoconductor in accordance with claim 1 wherein said metal oxide is surface treated with aluminum laurate, alumina, zirconia, silica, silane, methicone, dimethicone, sodium metaphosphate, or mixtures thereof.

12. A photoconductor in accordance with claim 1 wherein said metal oxide is a titanium oxide surface treated with an alkali metaphosphate.

13. A photoconductor in accordance with claim 1 wherein the thickness of the undercoat layer is from about 0.1 micron to about 30 microns.

14. A photoconductor in accordance with claim 1 wherein the thickness of the undercoat layer is from about 0.5 micron to about 15 microns.

15. A photoconductor in accordance with claim 1 wherein said charge transport layer is comprised of at least one of

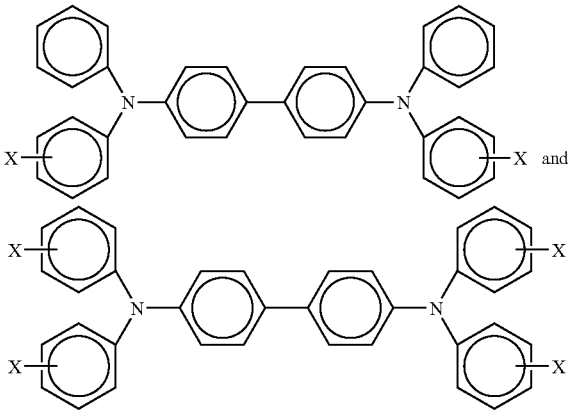

wherein X is selected from the group consisting of alkyl, alkoxy, aryl, and halogen, and mixtures thereof.

16. A photoconductor in accordance with claim 1 wherein said charge transport layer is comprised of at least one of

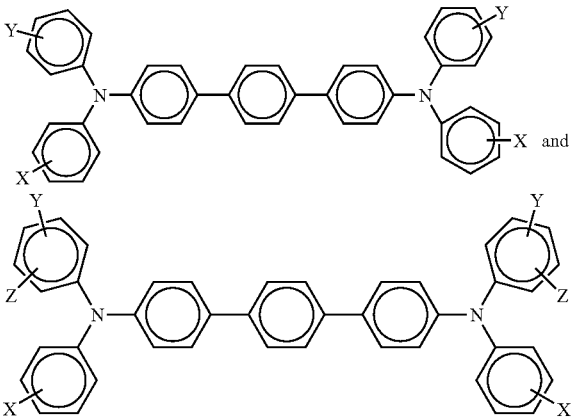

wherein X, Y, and Z are independently selected from the group consisting of alkyl, alkoxy, aryl, and halogen, and mixtures thereof.

17. A photoconductor in accordance with claim 1 wherein said charge transport layer is comprised of a component selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine.

18. A photoconductor in accordance with claim 1 wherein said photogenerating layer is comprised of at least one photogenerating pigment.

19. A photoconductor in accordance with claim 18 wherein said photogenerating pigment is comprised of at least one of a titanyl phthalocyanine, a hydroxygallium phthalocyanine, a halogallium phthalocyanine, and mixtures thereof.

20. A photoconductor in accordance with claim 1 wherein said at least one charge transport layer is from 1 to about 4 layers.

21. A photoconductor in accordance with claim 1 wherein said at least one change transport layer is comprised of a charge transport component and a resin binder, and wherein said photogenerating layer is comprised of at least one photogenerating pigment and a resin binder; and wherein said photogenerating layer is situated between said substrate and said charge transport layer.

22. A photoconductor comprising a substrate; an undercoat layer thereover comprised of a mixture of a metal oxide, at least one resin binder, and a component selected from the group consisting of at least one of iron (III) diethyldithiocarbamate, iron (III) dimethyldithiocarbamate, and N,N'-disalicylal-ethylenediamine iron (II); a photogenerating layer; and a charge transport layer.

23. A rigid or flexible photoconductor comprising in sequence a supporting substrate; a hole blocking layer comprised of a titanium oxide, at least one polymer binder, and an iron containing compound selected from the group consisting of iron (III) diethyldithiocarbamate, iron (III) dimethyldithiocarbamate, and N,N'-disalicylal-ethylenediamine iron (II); a photogenerating layer; and a charge transport layer.

24. A photoconductor in accordance with claim 22 wherein said resin binder is selected from the group consisting of phenolic resins, polyol resins, acrylic polyol resins, polyacetal resins, polyvinyl butyral resins, polyisocyanate resins, aminoplast resins, melamine resins, and mixtures thereof.

25. A photoconductor in accordance with claim 22 wherein said resin binder is comprised of a mixture of a first binder and a second binder.

26. A photoconductor in accordance with claim 25 wherein said resin binder is present in an amount of from about 30 to about 85 weight percent, and wherein said metal oxide is titanium oxide that possesses a primary particle size diameter of from about 10 to about 100 nanometers, an estimated aspect ratio of from about 3 to about 8, and wherein said oxide possesses a powder resistance of from about $1\times10^4$ to about $6\times10^5$ ohm/cm when applied at a pressure of from about 650 to about 50 kilograms/$cm^2$.

* * * * *